United States Patent [19]

Knapp

[11] Patent Number: 4,651,820

[45] Date of Patent: Mar. 24, 1987

[54] HEAT EXCHANGER HAVING ADJUSTABLE BAFFLES

[76] Inventor: Herfried Knapp, 21 Reuikpeul St., Weltevreden Park Ext. 4, Roodepoort, Transvaal, South Africa

[21] Appl. No.: 660,323

[22] Filed: Oct. 12, 1984

[30] Foreign Application Priority Data

Oct. 17, 1983 [ZA] South Africa ..... 83/7713
Sep. 24, 1984 [ZA] South Africa ..... 84/7497

[51] Int. Cl.[4] ..... F28D 7/10

[52] U.S. Cl. ..... 165/159; 165/76; 165/137; 165/176; 165/182

[58] Field of Search ..... 165/912, 76, 137, 182, 165/159, 162, 96, 97

[56] References Cited

U.S. PATENT DOCUMENTS

| | | | |
|---|---|---|---|
| 912,067 | 2/1909 | Brown | 165/137 X |
| 2,044,457 | 6/1936 | Young | 165/137 X |
| 2,496,301 | 2/1950 | Meixl | 165/162 X |
| 2,581,121 | 1/1952 | McCurdy, Jr. et al. | 165/162 X |
| 4,202,407 | 5/1980 | Woitowitz | 165/176 X |
| 4,203,906 | 5/1980 | Takada et al. | 165/159 X |
| 4,412,582 | 11/1983 | Mecozzi et al. | 165/159 X |
| 4,493,368 | 1/1985 | Gronnerud et al. | 165/159 |

*Primary Examiner*—William R. Cline
*Attorney, Agent, or Firm*—Kuhn Muller and Bazerman

[57] ABSTRACT

A heat exchanger of the type having a tube assembly made up of a number of tubes through which a first medium flows and around and between which a second medium flows to accept heat from, or transfer heat to, the first medium. One of the media is constrained by baffles to follow a tortuous path through the heat exchanger. According to the invention, the baffles are completely separate from the tubes, so permitting them to be replaced or adjusted without the necessity of disassembling the tube assembly. The baffles can be carried releasably on rods which allow their spacing to be adjusted at will, with the result that heat exchangers according to the invention are more versatile than conventional heat exchangers where the baffles are fixed to the tubes.

9 Claims, 10 Drawing Figures

HEAT EXCHANGER HAVING ADJUSTABLE BAFFLES

BACKGROUND TO THE INVENTION

This invention relates to a heat exchanger.

The type of heat exchanger here under consideration is one in which there is a plurality of tubes through which, in use, a first medium flows to accept heat from, or transfer heat to, a second medium flowing around and between the tubes. In such heat exchangers, one of the media is usually constrained to follow a tortuous path, so increasing its residence time in the heat exchanger and increasing the amount of heat which is transferred from one medium to the other.

Typical examples of prior art heat exchangers are seen in U.S. Pat. Nos. 2,391,244 (Jackson), 2,502,675 (Simpelaar), 2,48,145 (Tinker) and 3,351,131 (Berthold). In each of these patents, a series of spaced baffles span partially and transversely across the interior of the heat exchanger housing, and define the tortuous route which that medium flowing around the tubes is obliged to follow. In each case, the tubes of heat exchanger pass through the baffles. It is common for the baffles to be fixed permanently to the tubes, with the result that the baffles and tubes form an integral construction (see, for instance, the U.S. patents to Jackson, Simpelaar and Tinker mentioned above). In some cases, the tube fins, which are provided to increase the heat transfer area, serve the function of baffles (see, for example, the fins 16" in the Jackson patent). Sometimes also, the baffles are secured to the wall of the heat exchanger housing or shell.

A problem with the conventional fixed baffle heat exchangers is their lack of versatility. Heat exchangers are optimally designed for one application only in accordance with the flow parameters and heat exchange requirements expected in that applicaton. Where the heat exchanger designed for one application is used in another application in which the flow rate of the medium to be cooled is greater than the design flow rate, there is usually an unacceptable pressure drop in the system. If, on the other hand, the heat exchanger is used in an application in which the flow rate is less than the design flow rate, there is inefficient heat transfer to the cooling medium.

Heat exchangers with fixed baffle arrangements lack versatility in that it is not possible to cater for different flow parameters and heat exchange requirements by withdrawing the baffles and replacing them with a different baffle arrangement or adjusting the baffles. In fact, because the tubes pass through, and are often secured to, the baffles, it is not possible to withdraw the baffles without taking apart the whole tube assembly.

It is, however, not always economically feasible to design a heat exchanger specifically for the application in which it will be used, especially in the case of low capacity heat exchangers. As a result, the tendency is for consumers to use mass-produced heat exchangers in a variety of applications for which the heat exchangers are not specifically designed, resigning themselves to the attendant loss of efficiency.

It would obviously be desirable to have a heat exchanger which has greater versatility, and the present invention seeks to provide such a heat exchanger.

SUMMARY OF THE INVENTION

According to this invention, there is provided a heat exchanger comprising a tube assembly made up of a number of tubes through which a first medium flows in use and around and between which a second medium flows in use to accept heat from, or transfer heat to, the first medium flowing in the tubes, and a series of spaced baffles which serve to constrain one of the media to follow a tortuous path through the heat exchanger, characterised in that the baffles are completely separate from the tubes, so permitting them to be replaced or adjusted without the necessity of disassembling the tube assembly.

Preferably, the baffles are carried on rods extending through the heat exchanger, the positions of the baffles on the rods being adjustable to suit different media flow rates through the heat exchanger.

In one embodiment, the heat exchanger is a shell-and-tube heat exchanger wherein the first medium flows in use through the tubes of a tube assembly in the shell of the heat exchanger and the second medium flows in use around and between the tubes of the assembly, the adjustable baffles being arranged transversely to the tubes to constrain the second medium to follow a tortuous path which extends back and forth across the tubes. In this embodiment, the rods extend parallel to the tubes, and the baffles may be held adjustably in position on the rods by locknuts on the rods. Alternatively, the baffles may be held releasably in position on the rods by means of interchangeable sleeves on the rods.

This embodiment may be one in which the tubes pass transversely through a plurality of fins in the shell, the second medium flowing in use on its tortuous path transversely to the tubes between the fins, and in which the fins do not extend completely across the interior of the shell but have portions missing from their peripheries which correspond in shape to the baffles.

In another embodiment, the heat exchanger comprises a header tank having an inlet and an outlet for the first medium, a bottom tank, a plurality of parallel tubes spanning between the header and bottom tanks and placing them in communication with one another, and a plurality of adjustable baffles spaced apart on rods extending through the tanks transversely to the axes of the tubes to constrain the first medium to follow a tortuous path from the inlet to the outlet through the tubes.

The baffles in this embodiment may be spaced apart on the rods by interchangeable sleeves. In a preferred construction, the tanks have rectangular cross-sections formed by two opposing channel sections welded together along the edges of their legs, and the baffles are rectangular in shape to correspond to the interior shape of the tanks.

DESCRIPTION OF A PREFERRED EMBODIMENT

Figure 1:
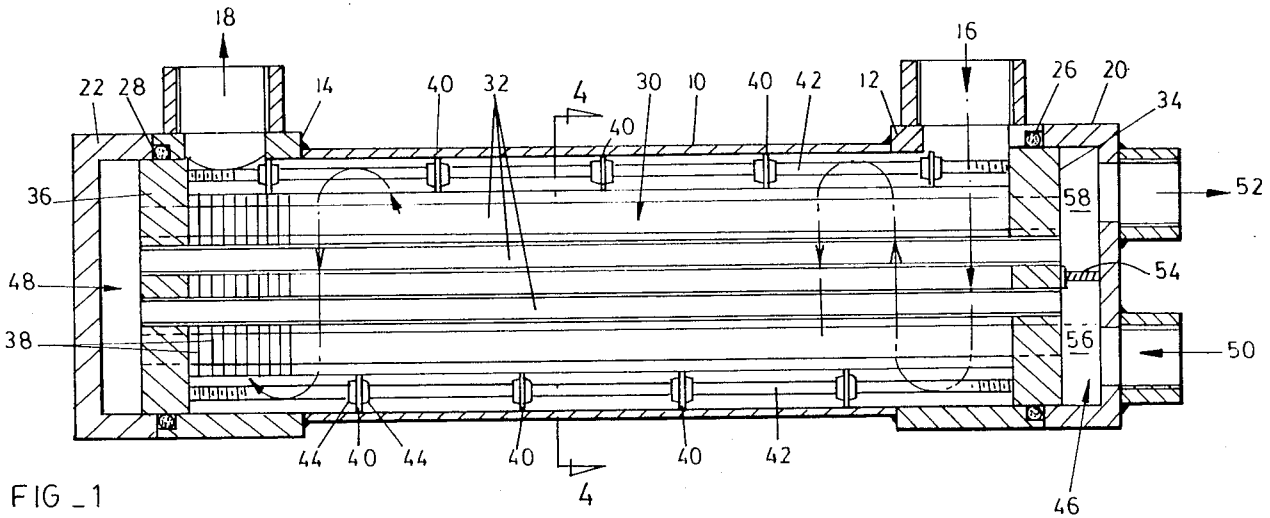
FIG. 1 is a view in longitudinal section of a heat exchanger of the invention taken along the line 1—1 in FIG. 3.
Figure 2:
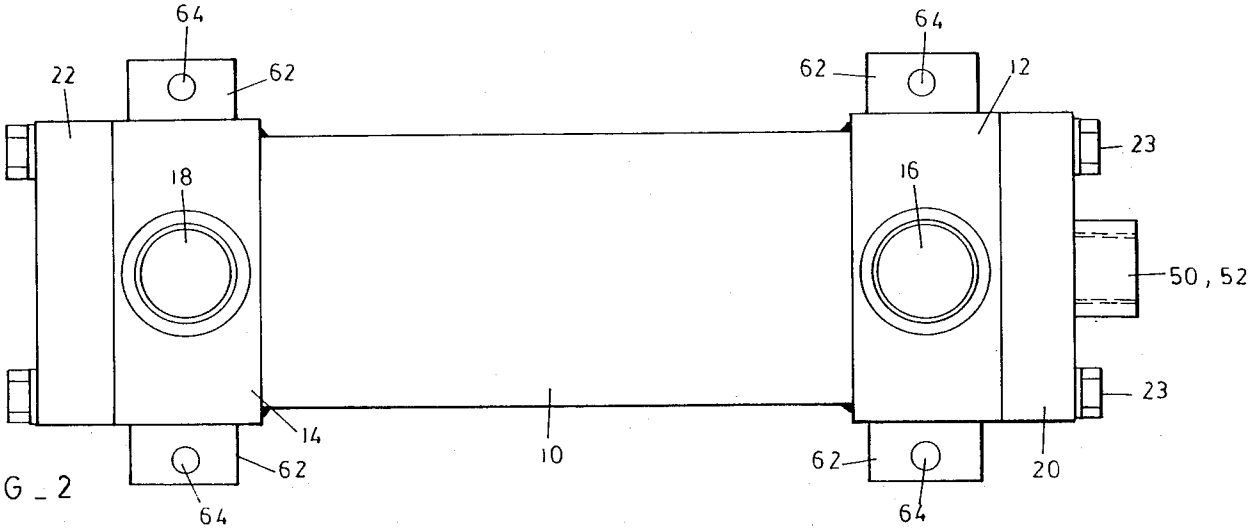
FIG. 2 is a plan view of the heat exchanger.
Figure 3:
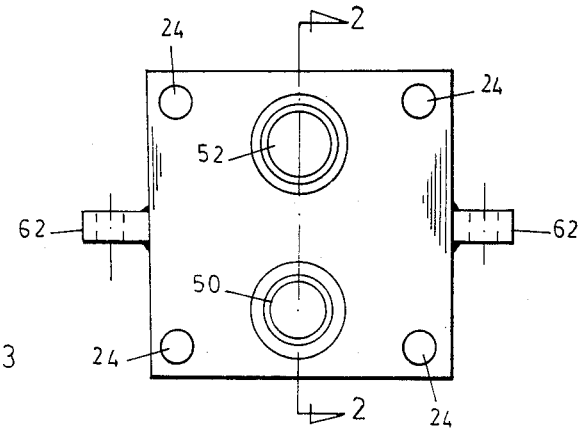
FIG. 3 is an end view of the heat exchanger.

The shell-and-tube heat exchanger illustrated in FIGS. 1 and 2 has a shell having a cylindrical wall 10 with rectangular collars 12 and 14 welded to its ends. The collars 12 and 14 provide a hot medium inlet 16 and a hot medium outlet 18 respectively.

Rectangular end caps 20 and 22 are bolted to the collars 12 and 14 by means of bolts 23 passing through holes 24 at thickened corners of the end caps into thickened corners of the collars. O-rings 26 and 28 are sandwiched between the end caps and the collars.

Figure 4:
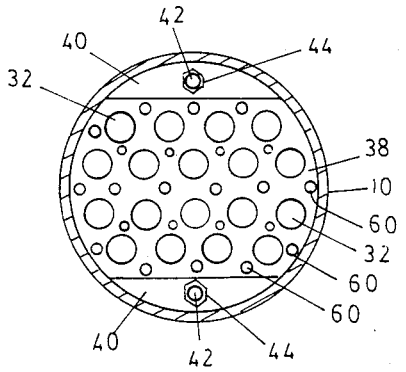
FIG. 4 is a section at the line 4—4 in FIG. 1.

A tube bundle 30 is movable within the shell. It includes a series of tubes 32 welded at either end in openings formed in end plugs 34 and 36 against which the O-rings 26 and 28 seal. Spaced apart on the tubes and fixed to them are a great number of fins 38. As is shown in FIG. 4, each fin 38 has the shape of a circle from which has been removed diametrically opposing segments. Fixture of the tubes in the fins can be achieved in any conventional way e.g. by welding or by expanding the tubes into the holes in the fins.

The tube bundle also includes a series of baffles 40 held releasably on elongated, threaded rods 42 by means of opposed lock-nuts 44. Each baffle 40 has the shape of a segment of a circle, its dimensions corresponding to the dimensions of the segments removed from the circles forming the fins 38. The rods 42 span between the end plugs 34 and 36.

There are spaces 46 and 48 at the ends of the tube bundles, between the end plugs and the end caps. The end cap 20 provides a cooling medium inlet 50 and a cooling medium outlet 52. A lateral baffle 54 is welded to the interior of the end cap 20 and divides the space 46 into an inlet space 56 and an outlet space 58. The edge of the baffle 54 remote from the end cap 22 bears upon the end plug 34 and spaces it from the end cap.

Figure 5:
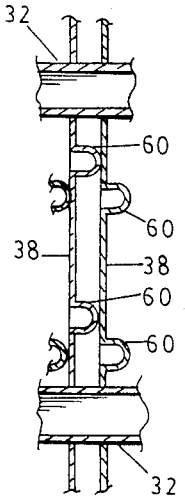
FIG. 5 shows a detail of the nature of the fins.

FIG. 5 illustrates the nature of the fins in more detail. Each fin has pressed from it a series of staggered projections 60 which extend in the axial direction of the tube bundle into contact with the next adjacent fin. It will be seen that the projections are formed by deforming the fins, rather than by cutting or punching through them. The projections are therefore continuous with the material of the fins and provide no apertures through the fins through which the hot medium can short-circuit in use. The projections on the respective fins are staggered with respect to one another.

In operation, the hot medium, e.g. a hot gas or oil is introduced into the shell through the inlet 16. It is constrained by the baffles to flow along a tortuous path such as that depicted by the arrows i.e. transversely to the tubes 32, from the inlet to the outlet 18. A cooling medium e.g. water is introduced into the space 56 from where it flows through the lower tubes 32 to the space 48, returning through the upper tubes to the space 58 and escaping through the outlet 52. For one half of its journey through the heat exchanger, the water flows parallel to the hot medium flow, and for the other half, it flows in counter-flow.

The projections 60 on the fins promote turbulence of the hot medium as it flows between the fins, and hence promote the heat exchange sought. The projections 60 used in this apparatus provide a considerable advantage over those previously known apparatuses which employed axial projections in the form of tabs punched out from the material of the fins, the reason being that such previous constructions permitted some short-circuiting of the hot medium through the holes left in the fins after the punching operation.

If the flow parameters should change for any reason, e.g. if the heat exchanger should be required to operate in a different application, it is possible to move the baffles about on the rods 42 to vary their spacing to an optimum value to suit the new flow rate of hot medium.

This endows the heat exchanger with considerable versatility, and can be achieved simply by removing the bolts holding the end cap 20 in position, sliding the tube bundle out of the shell, adjusting the positions of the lock nuts on the rods 42, and replacing the tube bundle and end cap. Note that the use of O-rings instead of conventional packing makes the re-sealing operation simple. Note also that, because the baffles are completely separate from the tube bundle, the tube bundle does not have to be taken apart when the baffle spacing is to be changed to suit different media flow rates.

Note also that the collars 12 and 14 carry holed lugs 62 for mounting purposes. A series of such heat exchangers can be stacked above one another with vertical rods passing through the holes 64 in the lugs to ensure their alignment with one another.

Figure 6:
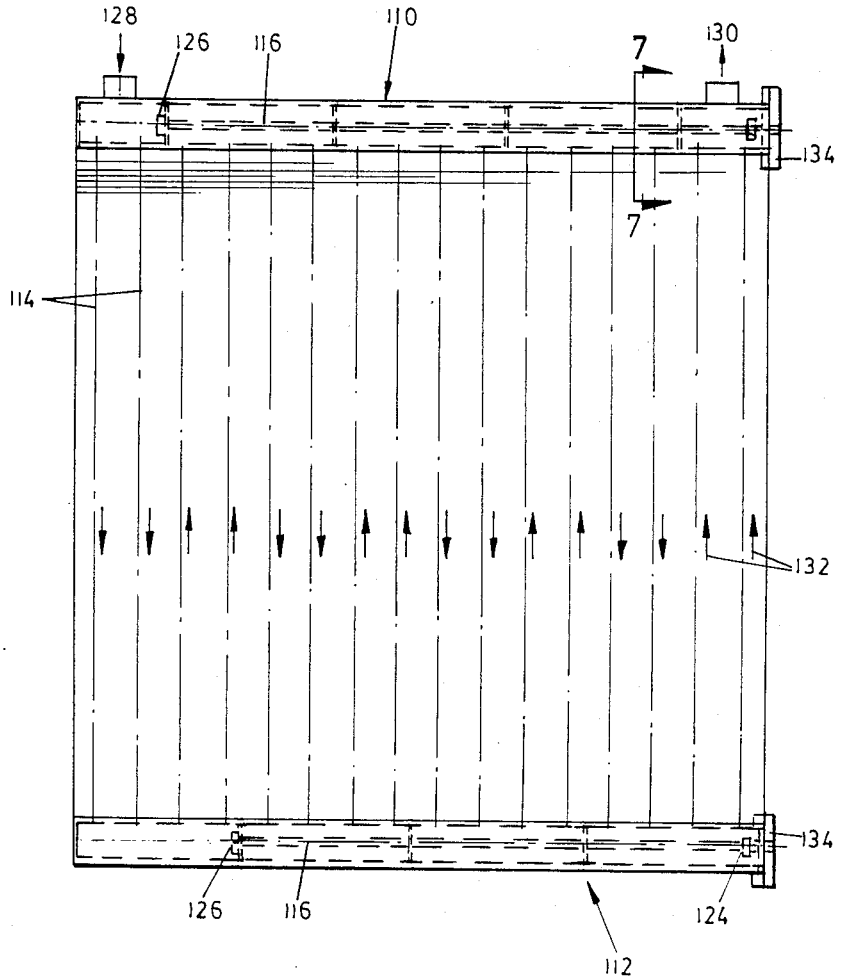
FIG. 6 shows a schematic elevation of another embodiment of heat exchanger according to the invention.
Figure 7:
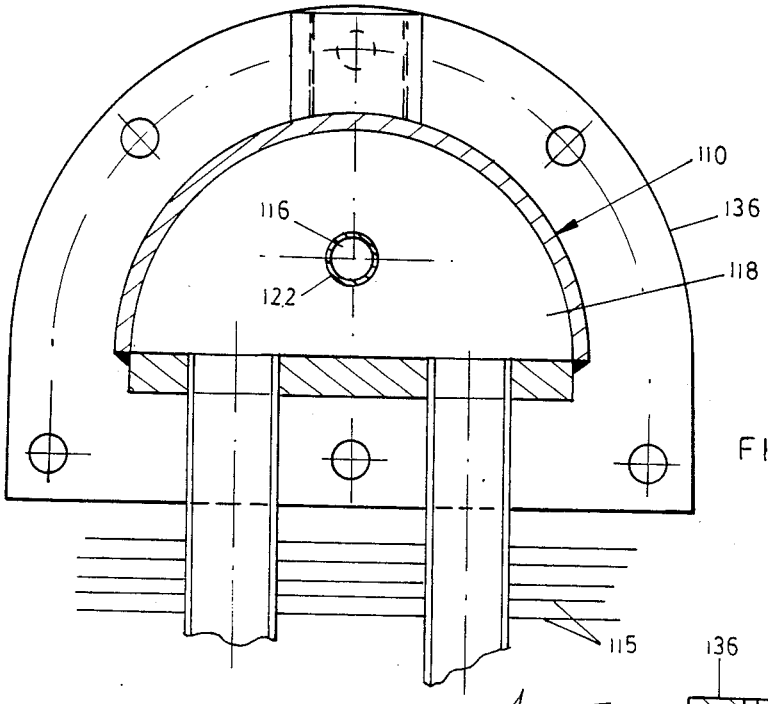
FIG. 7 shows a section at the line 7—7 in FIG. 6.
Figure 8:
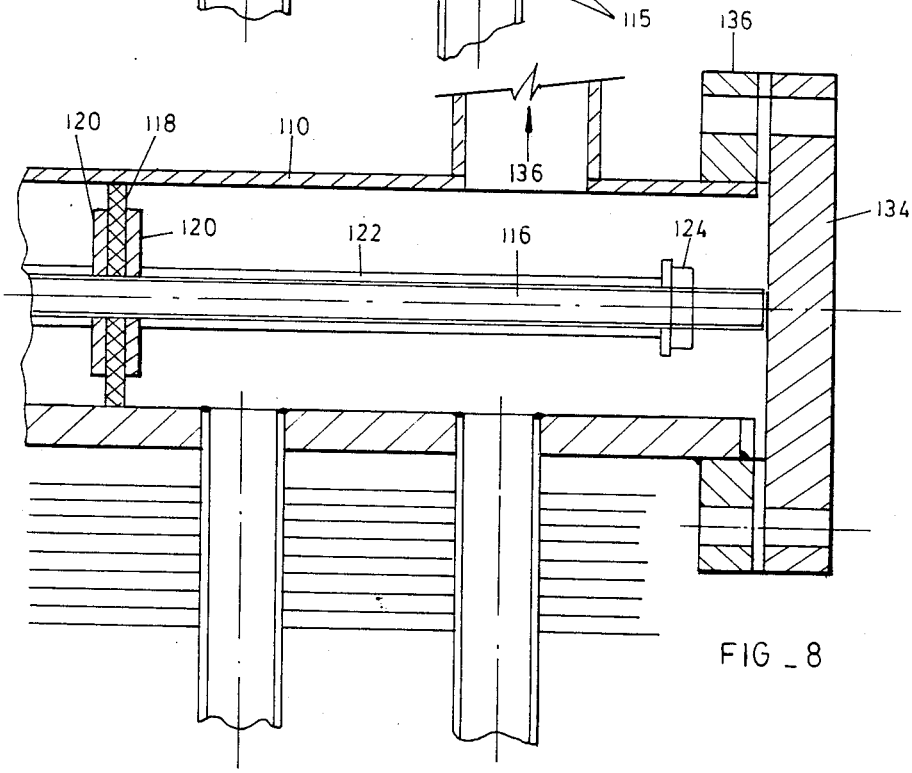
FIG. 8 shows an enlarged sectional view of a part of the heat exchanger of FIGS. 6 and 7.

The embodiment of FIGS. 6 to 8 has a header arrangement and is basically of a type commonly used in motor vehicle radiators.

This embodiment has header and bottom tanks 110 and 112 of semi-circular cross-section (see FIG. 7) with a series of tubes 114 arranged vertically between the tanks and communicating them one with the other. The tubes 114 pass through a great number of transverse fins of conventional type (shown schematically at 115 in FIG. 7).

Extending longitudinally through the header and bottom tanks are threaded rods 116 carrying spaced baffles 118 of semi-circular shape as seen in FIG. 7. The baffles are of a flexible material and are clamped between opposing plattes 120, which expand them outwardly into tight engagement with the walls of the tanks to prevent leakage past them. Rigid sleeves 122 are arranged about the rods 116 between the plates 120 to maintain the spacing of the baffles. Nuts 124 and 126 on the rods 116 fix the positions of the end sleeves.

In use, a hot medium, such as hot water from the cooling jacket of an internal combustion engine, enters the header tank 110 through an inlet 128 and leaves through an outlet 130. En route from the inlet to the outlet, the hot medium is constrained by the baffles 118 to follow a tortuous path through the tanks and tubes, as shown by the arrows 132. A cooling medium, such as air, flows through the heat exchanger between the fins and tubes to accept heat from the medium flowing in the tubes.

Note that the header tank 110 need not have the semi-circular cross section shown in FIG. 7. It is also possible for the header and bottom tank each to consist of two opposed channel members welded together along the free edges of their legs to form a rectangular cross-section. The advantage of this arrangement is that the welds are not located in regions where the wall of the tank undergoes a sharp change in direction. As a result, the stress concentration on the welds is reduced, and the integrity of the tank is improved. Of course, with this preferred construction, the baffles will have rectangular shapes so that they conform to the interior of the tank.

The baffle spacing is adjustable to suit different flow rates of the hot medium. This is achieved merely by releasing bolts (not shown) which clamp end caps 134 to flanges 136 at the ends of the header tank and bottom tank, withdrawing the rods 116 from the tanks, releasing the nuts 124 and 126, removing the baffles 118, sleeves 122 and plates 120, and reassembling the assembly with sleeves 122 of different lengths between the plates 120. As in the case of the first embodiment, there is no need to take the tube assembly apart.

Figure 10:
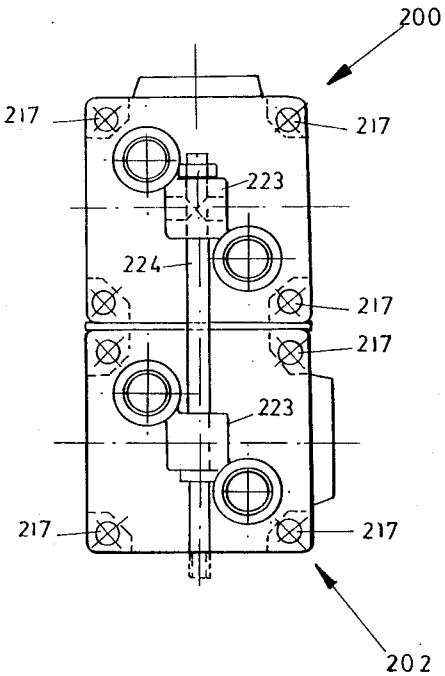
FIG. 10 is an end view of the assembly of FIG. 9.
Figure 9:
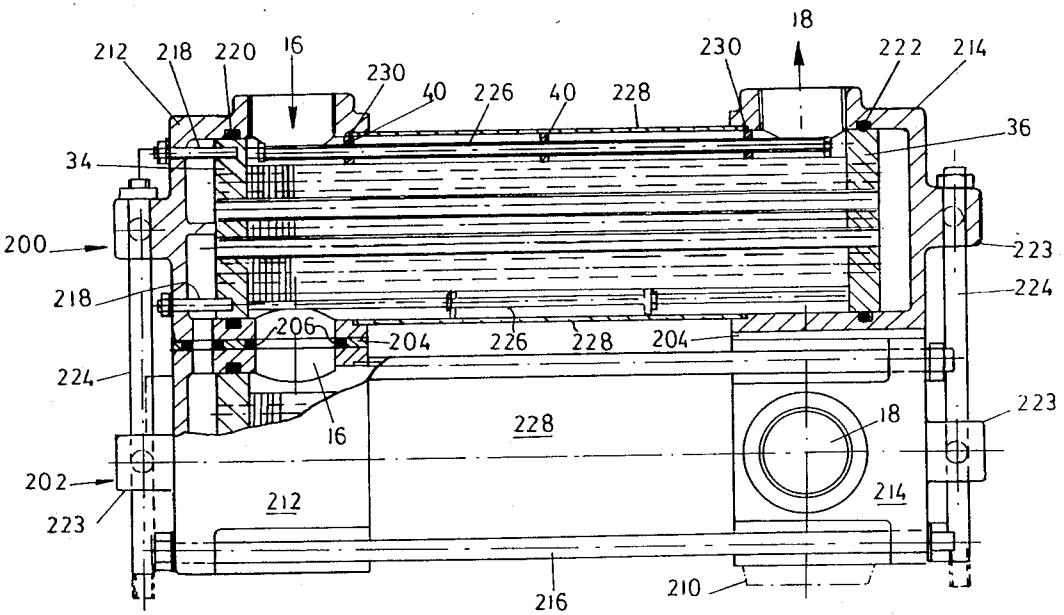
FIG. 9 is a view, partly in longitudinal section, of an assembly of heat exchangers of a further embodiment.

The heat exchangers 200 and 202 seen in FIGS. 9 and 10 are similar in many respects to that of FIGS. 1 to 5, and the like components are similarly numbered. The heat exchangers are arranged in a banked assembly one above the other with plates 204 and seals 206 interposed between them. The hot medium inlet 16 of the upper heat exchanger 200 is aligned with the inlet 16 of the lower heat exchanger, and the hot medium outlets 18 are 90° out of phase. The outlet 18 of the lower heat exchanger 202 could be vertically directed instead of horizontally inclined as shown by the dotted line 210.

The major difference between each of the heat exchangers of the assembly and that shown in FIGS. 1 to 5 is the provision of unitary end caps 212, 214 in place of the collars 12, 14 and end caps 20, 22. The unitary end caps are held in position by means of longitudinally extending bolts 216 passing through holes 217 in thickened corners of the end caps. The use of unitary end caps, which can be formed as unitary castings, at least in smaller heat exchangers, simplifies the overall construction.

The end plug 34 is held in position relative to the end cap 212 by means of short screws 218, while the end plug 36 is free to move axially with respect to the end cap 214. Sealing rings 220, 222 corresponding to the O-rings 26, 28 seal the end plugs with respect to the end caps. It will be seen the sealing arrangement provided by the use of the O-rings 220, 222 is considerably simpler than the arrangement seen in the embodiment of FIG. 1, and this can be attributed to the use of the unitary end caps 212, 214.

The end caps have axially extending holed bosses 223 through which pass vertical rods 224 which align the two heat exchangers with one another in the banked arrangement.

In this embodiment, the movable baffles in each heat exchanger are spaced apart by interchangeable sleeves 226 in the same manner as the baffles 118 of FIGS. 6 to 8.

The end caps are mounted at either end of cylindrical shells with seals 230 interposed between the ends of the shells and the end caps.

I claim:

1. A shell-and-tube heat exchanger comprising a tube assembly made up of a number of tubes through which a first medium flows in use and around and between which a second medium flows in use to accept heat from, or transfer heat to, the first medium flowing in the tubes, and a series of spaced baffles carried on rods extending through the heat exchanger, the positions of the baffles on the rods being adjustable to suit different media flow rates, being arranged transversely to the tubes to constrain the second medium to follow a tortuous path which extends back and forth across the tubes and being completely separate from the tubes, so permitting them to be replaced or adjusted without the necessity of disassembling the tube assembly, wherein the tubes pass transversely through a plurality of fins in the shell, the second medium flowing in use on its tortuous path transversely to the tubes between the fins and wherein the fins do not extend completely across the interior of the shell but have portions missing from their peripheries which correspond in shape to the baffles.

2. The heat exchanger of claim 1, in which the rods extend parallel to the tubes and are threaded, the baffles being held adjustably in position on the rods by locknuts on the rods.

3. The heat exchanger of claim 1, in which the rods extend parallel to the tubes and the baffles are held releasably in position on the rods by means of interchangeable sleeves on the rods.

4. The heat exchanger of claim 1, in which the shell is round cylindrical, the baffles each have the shape of a segment of a circle of the same diameter as the shell and the fins each have the shape of a circle of the same diameter as the shell from which has been removed diametrically opposite segments of the same shape as the baffles.

5. The heat exchanger of claim 1, in which each fin comprises a plate formed with a plurality of projections standing proud of the general plane of the plate and contacting the plate of the next adjacent fin.

6. The heat exchanger of claim 5, in which the projections of the fins are formed without cutting through the material of the plate.

7. The heat exchanger of claim 6, in which the projections of each fin are staggered with respect to one another and with respect to the projections of the next adjacent fin.

8. The heat exchanger of claim 1, and including end caps at either end of the shell, the end caps being of unitary construction and being sealed by means of O-rings with respect to end plugs in which the ends of the tubes conveying the first medium are located.

9. The heat exchanger of claim 8, in which the unitary end caps carry holed bosses through which elongate rods can be passed to align a plurality of heat exchangers with one another in a banked assembly of heat exchangers.

* * * * *